US006935588B2

(12) United States Patent
Blair et al.

(10) Patent No.: US 6,935,588 B2
(45) Date of Patent: Aug. 30, 2005

(54) TRANSPORTABLE SHREDDING MACHINE

(75) Inventors: Leonard G. Blair, Malvern, PA (US); Steven J. DiMascio, Elverson, PA (US)

(73) Assignee: Concept Products Corporation, Paoli, PA (US)

( * ) Notice: Subject to any disclaimer, the term of this patent is extended or adjusted under 35 U.S.C. 154(b) by 208 days.

(21) Appl. No.: 10/461,651

(22) Filed: Jun. 13, 2003

(65) Prior Publication Data

US 2004/0251352 A1 Dec. 16, 2004

(51) Int. Cl.[7] ..... B02C 21/02
(52) U.S. Cl. ..... 241/101.76; 241/285.3
(58) Field of Search ..... 241/285.2, 285.3, 241/101.71–101.77

(56) References Cited

U.S. PATENT DOCUMENTS

| | | | | |
|---|---|---|---|---|
| 2,464,217 A | | 3/1949 | Dillingham | |
| 2,981,485 A | | 4/1961 | Mainone | |
| 3,090,515 A | | 5/1963 | Crowther | |
| 3,133,727 A | | 5/1964 | Luscombe | |
| 3,826,353 A | | 7/1974 | Greasley | |
| 3,913,850 A | * | 10/1975 | Daniel | 241/101.74 |
| 3,929,294 A | | 12/1975 | Cox | |
| 4,374,573 A | * | 2/1983 | Rouse et al. | 241/101.76 |
| 4,390,312 A | * | 6/1983 | Skeem | 414/24.6 |
| 4,655,402 A | * | 4/1987 | Desourdy | 241/76 |
| 4,961,539 A | | 10/1990 | Deem | |
| 5,263,654 A | | 11/1993 | Young | |
| 5,294,065 A | | 3/1994 | Harms et al. | |
| 5,307,917 A | | 5/1994 | Hall | |
| 5,402,950 A | | 4/1995 | Blair et al. | |
| 5,819,950 A | | 10/1998 | McCloskey | |
| 6,129,196 A | | 10/2000 | Lapper et al. | |
| 6,186,338 B1 | | 2/2001 | Douglas | |
| 6,270,027 B1 | | 8/2001 | Premo | |

OTHER PUBLICATIONS

REXWORKS, Megagrind advertising, 1995, pp 1–4, Milwaukee.
REXWORKS, Maxigrind advertising, date unknown, pp 1–4, Milwaukee.
REXWORKS, Biogrind advertising, 1996, pp 1–4, Milwaukee.
FECON, MZA Mobile Organic Resource Processors advertising, 1997, pp 1–4, Cincinnati.
Grindstar Model 48G advertising, date unknown, pp 1–2, Duluth.
MAC Corporation of America, Hydragrind 260 advertising, date unknown, pp 1–2, Grand Prairie.
Concept Products Corporation, Shred–All advertising, date unknown, pp 1–4, Paoli.

* cited by examiner

*Primary Examiner*—Mark Rosenbaum
(74) *Attorney, Agent, or Firm*—Howson and Howson

(57) ABSTRACT

A transportable shredder comprises a comminutor, a horizontal intake conveyor on one side of the comminutor, and a discharge conveyor movable from a stowed position, where it is partly underneath the intake conveyor, to an operating position where it extends obliquely upward on the discharge side of the comminutor. The discharge conveyor has journals which are releasably held in bearings formed by latches and cooperating notches.

17 Claims, 5 Drawing Sheets

TRANSPORTABLE SHREDDING MACHINE

FIELD OF THE INVENTION

This invention relates to shredding machinery, and more particularly to transportable machinery for reducing used pallets, shipping crates, other wood articles such as tree material, cardboard and the like, to chips usable as horticultural mulch. The invention also has utility in shredding other materials such as drywall and other building debris.

BACKGROUND OF THE INVENTION

A typical transportable shredding machine is a trailer-mounted assembly having a hopper for receiving wood articles, etc., a gasoline or diesel engine-powered comminutor, and a conveyor arranged to transport chips from the comminutor along an upwardly sloping path for discharge into a pile or into the body of a truck or trailer so that they can be hauled away. A typical trailer-type shredding machine is described in U.S. Pat. No. 5,402,950, dated Apr. 4, 1995.

In the shredding machine described in U.S. Pat. No. 5,402,950, the discharge conveyor is pivotable from a position in which it extends upward and to one side of the trailer for discharge of chips, to a nearly upright position for transport. When the discharge conveyor is nearly upright, the center of gravity of the machine, including the trailer, is above a position located centrally between the right and left wheels of the trailer. The conveyor is also positioned inboard of the wheels so that it will not interfere with other vehicles on the highway in turns.

Other transportable shredding machines have discharge conveyors that extend upward and to the rear of the trailer. Some of these rearwardly sloping discharge conveyors are fixed in relation to the trailer. Others are pivotable to a nearly upright position. Still others are designed to fold up and over the trailer. The pivoting or folding of the rearwardly extending conveyors shortens the overall length of the machine for transportation. It also moves the overall center of gravity of the machine, including the trailer, forward somewhat.

A discharge conveyor is, by necessity, heavy, and its weight constitutes a substantial fraction of the overall weight of the trailer and machinery mounted on the trailer. A fixed, rearwardly extending, discharge conveyor, causes the position of the center of gravity of the trailer to be located well toward the rear of the trailer, requiring the wheels to be positioned further toward the rear, and requiring the trailer to be constructed so that the weight forward of the wheels balances the weight to the rear of the wheels so that the trailer exerts a moderate downward force on the trailer hitch of the towing vehicle. The rearward positioning of the wheels makes it more difficult to balance the load on the trailer, impairs the maneuverability of the trailer and towing vehicle, and adversely affects the safety of the trailer and towing vehicle on the highway. Because of the requirement for balance, the overall weight of the trailer, together with the machinery on the trailer, is higher.

The weight of the discharge conveyor will cause the trailer to react excessively to irregularities in the highway surface. Moreover, the discharge conveyor must be securely attached to the trailer to prevent its inertia from causing breakage of fasteners and frame components of the trailer and of the conveyor itself. Moreover, in some case, in the interest of better balance, the gasoline or diesel engine is positioned toward the front of the trailer and remote from the comminutor, requiring special coupling to transmit power from the engine to the comminutor, and increasing the overall length of the trailer.

Even in the case of a rearwardly extending, pivotable, discharge conveyor, the center of gravity is still too far to the rear when the conveyor is pivoted upward. Consequently, problems due to excess weight also exist in these machines and measures must be taken to balance the trailer and machine assembly fore and aft of the trailer axle or axles. Moreover in the case of a pivoting conveyor, whether it be a rearwardly extending conveyor or a sidewardly extending conveyor, additional difficulties arise in preventing breakage due to inertia, and in securing the conveyor against movement relative to the trailer, due to highway irregularities.

Folding conveyors offer a partial solution to the balance problem, but are structurally more complicated than a pivoted conveyor, and often heavier.

In transportable shredders, the weight of the towed shredding equipment, trailer and discharge conveyor is an important consideration, as is the combined weight of the towed equipment and the towing vehicle. A unit weighing up to 12500 pounds can be towed by a heavy ¾ ton pickup truck. However, if the overall weight is greater than 12500 pounds, a heavier towing vehicle is required, which will generally result in a combined weight greater than 26000 pounds.

If the combined weight is 26000 pounds or more, the acquisition cost of the towing vehicle is higher, and the cost of tolls and fuel is higher. A commercial driver's license is also required, and consequently fewer available qualified vehicle operators are available, and they command a higher pay scale. In many cases, it is also difficult to transport the heavier equipment into and away from a job site.

SUMMARY OF THE INVENTION

An object of this invention is to provide a transportable shredding machine that avoids the problems of heavy shredding equipment without compromising performance. Other objects of the invention include reduction of cost of acquisition and operation of shredding equipment and towing vehicles, easier operation, and improvement in safety of operation.

The shredder in accordance with the invention comprises a machine frame having wheels, a comminutor mounted on the machine frame, the comminutor having an intake side and a discharge side opposite from the intake side, an intake conveyor mounted on the machine frame on the intake side of the comminutor and arranged to carry articles to be shredded toward the comminutor, and a discharge conveyor. The discharge conveyor is movable from a stowed position, in which a part of the discharge conveyor is disposed underneath the intake conveyor, to an operating position in which the discharge conveyor extends obliquely upward, and in which at least part of the discharge conveyor is located on the discharge side of the comminutor.

In a preferred embodiment, a guide is provided for guiding movement of the discharge conveyor in a horizontal path from its stowed position to an extended position in which the discharge conveyor extends horizontally away from the comminutor on the discharge side of the comminutor. A lifting mechanism is provided for lifting the discharge conveyor from the extended position to its operating position.

In the preferred embodiment, a motor arranged to drive the comminutor is supported, on a motor support extending upward from the machine frame, at a location adjacent the comminutor. The lifting mechanism comprises a member engageable with the discharge conveyor, and at least one linear actuator having first and second relatively movable parts, the first part being affixed to the motor support at a location above the machine frame, and the second part being connected to the member engageable with the discharge conveyor. The member engageable with the discharge conveyor is preferably a roller positionable underneath the discharge conveyor frame when the discharge conveyor is in its extended position, and engageable with the discharge conveyor frame to lift the discharge conveyor frame in response to operation of the linear actuator. The motor support includes a guide rail extending upward from the machine frame, and a guide connected to the second of the two relatively movable parts of the linear actuator is constrained to travel along the guide rail.

The discharge conveyor comprises a discharge conveyor frame having proximal and distal ends, an endless movable conveyor belt supported on the discharge conveyor frame, and preferably a pair of journals extending laterally from the discharge conveyor frame adjacent the proximal end thereof, the journals being aligned with each other on a pivot axis. Bearings, mounted on the machine frame adjacent a comminutor discharge opening, are positioned to support the journals rotatably when the discharge conveyor is in its extended position. At least one of these bearings comprises a first part having a notch for receiving one of the journals as the conveyor is moved into its extended position, and a latch for releasably holding the journals in the notch. Where the latch is near the discharge opening of the comminutor, it may be difficult to reach, and accordingly an elongated control arm is preferably provided for manually opening and closing the latch, so that the latch can be operated from a location remote from the discharge opening of the comminutor. Preferably, both bearings have notches and pivoted latches, the latches being pivotable and controlled by elongated control arms.

A significant advantage of the shredder in accordance with the invention is reduction in weight. A shredder having a throughput capability comparable to that of a much heavier conventional shredder can be towed by a heavy ¾ ton pickup truck, and the overall weight of the shredder and the towing vehicle can be held at under 26000 pounds. As a result, a commercial driver's license is not required, the towing vehicle acquisition cost is reduced, the cost per mile to move the shredder is lower, and a saving in tolls and fuel can be realized. A dedicated tow vehicle is not necessary. The tow vehicle can be a pickup truck, and can be used as the owner's or operator's personal transportation. The reduced size of the shredder also makes it easier to maneuver the equipment on the highway and to move it into and out of a job site, and the shredder can be of a size such that it can be parked in an ordinary automobile parking space.

The shredder in accordance with the invention is also less susceptible than conventional shredders to damage as a result of the effect of inertia on the discharge conveyor during transport. Moreover, since the discharge conveyor can be stowed partially underneath the intake conveyor, unlike a conventional discharge conveyor, it does not swing in a large arc during turns as the shredder is transported.

Other objects, details and advantages of the invention will be apparent from the following detailed description when read in conjunction with the drawings.

DETAILED DESCRIPTION OF THE PREFERRED EMBODIMENT

Figure 1:
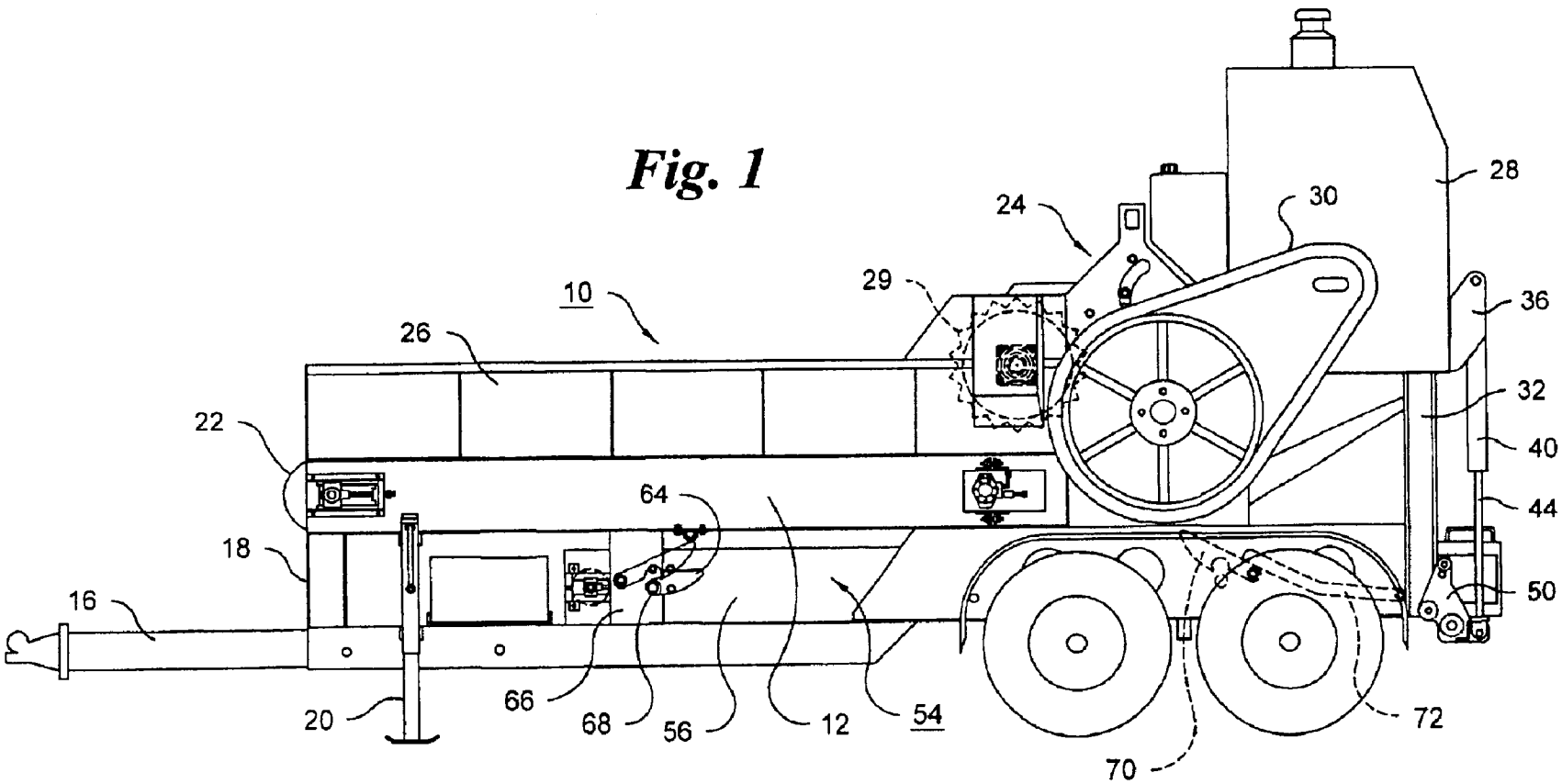
FIG. 1 is a side elevation of a shredder in accordance with the invention, with the discharge conveyor in its stowed position.

Referring to FIG. 1, the shredder 10 is in the nature of a trailer, comprising a frame 12, with wheels 14 and a tow hitch 16 extending horizontally forward from a front end 18 of the trailer. A pair of jacks, one of which is shown at 20, is provided near the front end to support the front end of the frame during operation, when the towing vehicle is removed.

An intake conveyor 22 comprises an endless belt, which carries material to be shredded in the rearward direction toward the comminutor 24, above the frame 12 and between a pair of side panels, one of which is shown at 26. The side panels define an open-ended intake hopper. The comminutor is driven by an internal combustion engine 28 through a belt drive mechanism 30. The upper run of the belt travels over, and is supported by, a support plate (not shown). A toothed drum 29, mounted for rotation and vertical movement above the belt, assists the belt in moving materials into the comminutor.

The engine 28 is mounted above the frame 12, near the rear of the trailer, on supports including members 32 and 34 (FIG. 4), which are preferably in the form of upright channels. Also connected to the respective upright members 32 and 34 are brackets 36 and 38. Cylinders 40 and 42 of vertically disposed, linear hydraulic actuators are affixed to these brackets at locations spaced vertically above the frame 12. The pistons 44 and 46 of the actuators are connected to a horizontal roller 48, which is movable vertically by operation of the actuators. The roller 48 is constrained to move in a vertical path by guides, one of which is shown at 50 in FIGS. 1 and 5. These guides have rollers which travel on flanges on the upright members 32 and 34.

Figure 4:
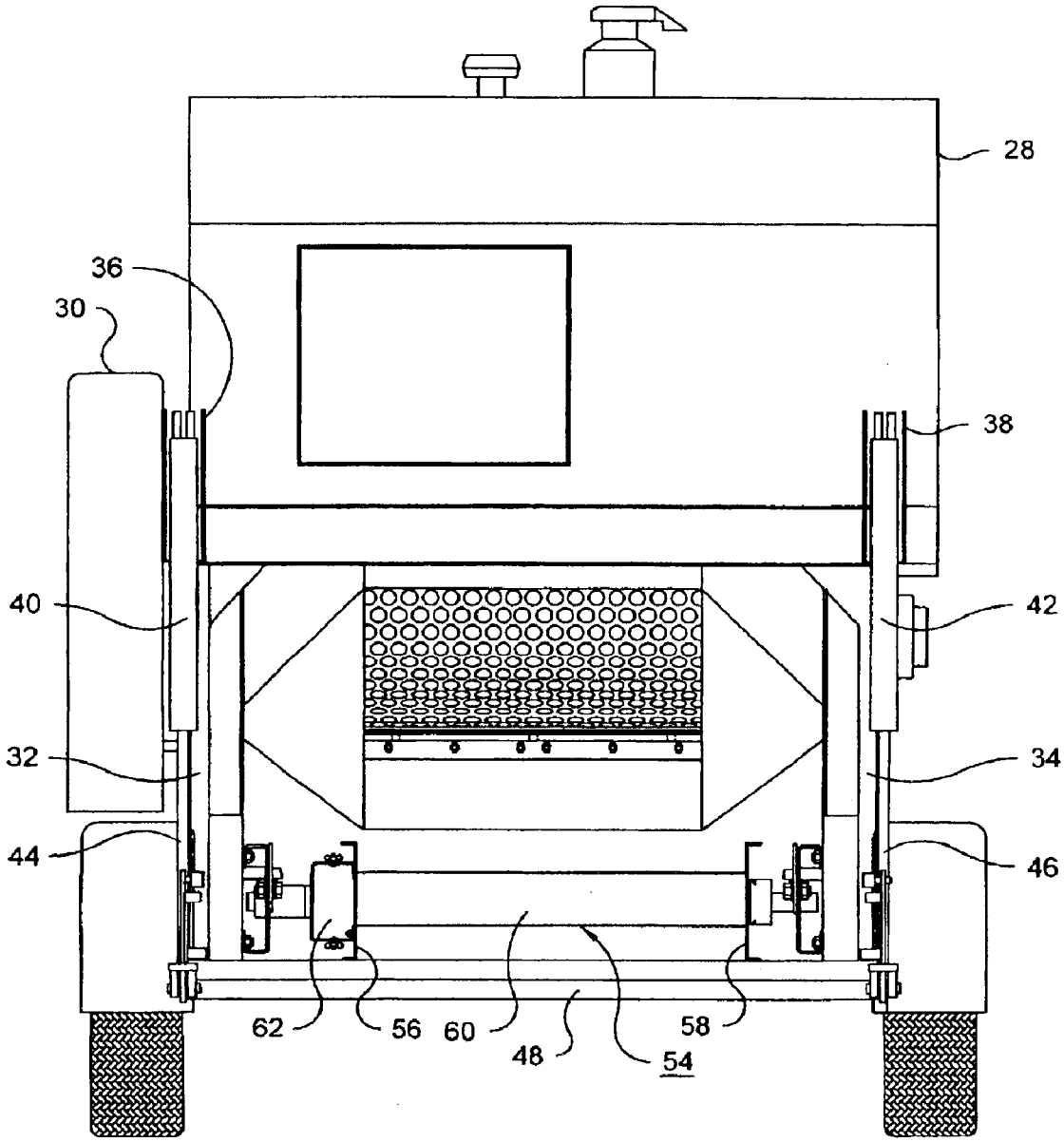
FIG. 4 is a rear elevation of the shredder of FIG. 1.

The comminutor comprises a toothed drum (not shown), which cooperates with an arcuate, cylindrical discharge screen 52, seen in FIG. 4, to discharge chips onto a discharge conveyor 54.

Figure 5:
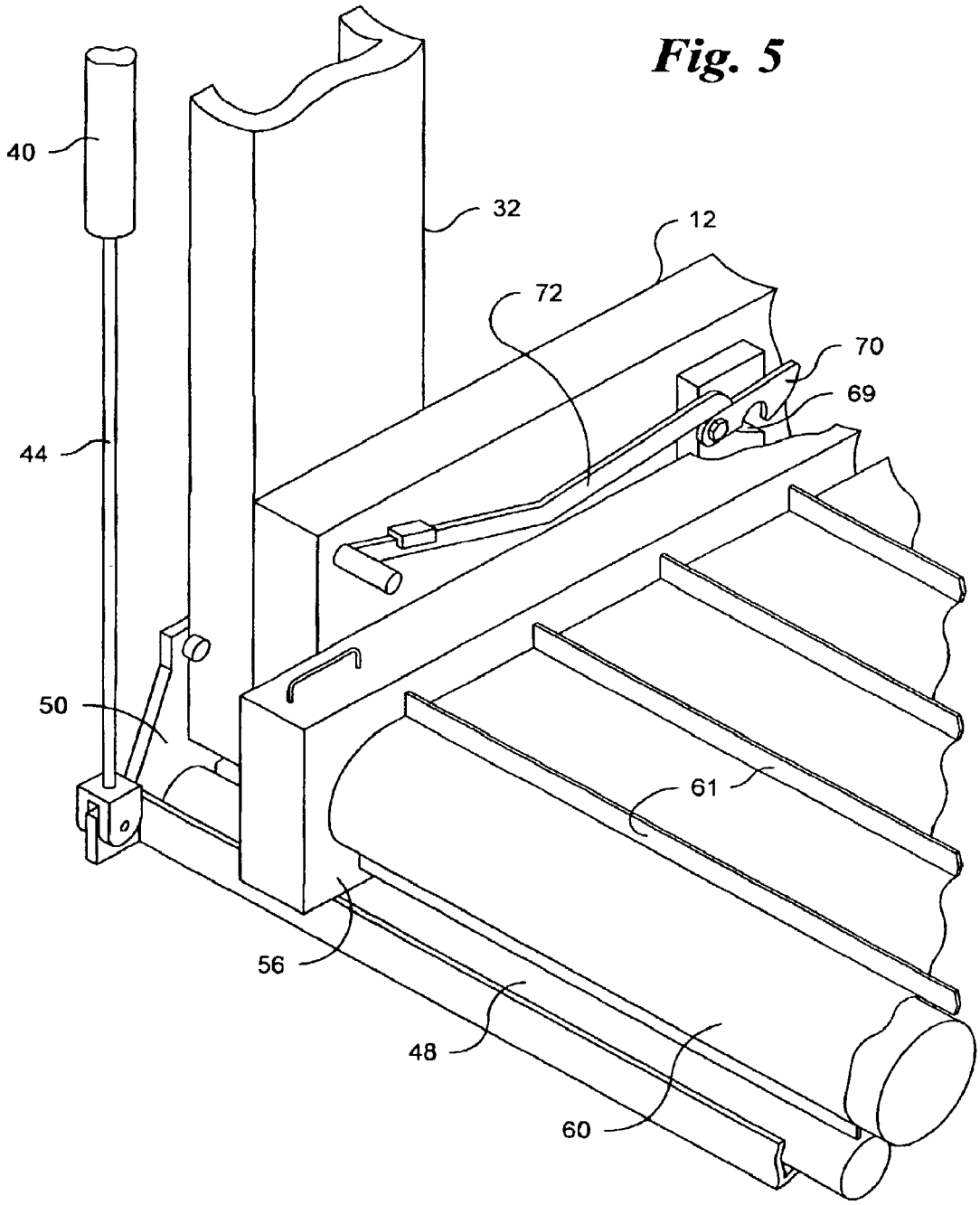
FIG. 5 is a fragmentary perspective view showing the discharge conveyor in its stowed position.

As shown in FIG. 4, the discharge conveyor comprises a frame composed of two horizontally elongated, parallel channel members 56 and 58, having an endless belt 60 between them, extending between front and rear rollers (not shown). The discharge conveyor belt also runs over, and is supported by, a support plate (not shown). The belt is preferably provided with laterally extending ribs 61 disposed at regular intervals as shown in FIG. 5, for ensuring that chips produced by the comminutor will be moved upward by the belt. The rear roller of the discharge conveyor is driven by a hydraulic motor 62, operated by a pump(not shown), the pump being powered by the engine 28 through a flexible hydraulic line (not shown).

As shown in FIG. 1, latches are provided to hold the discharge conveyor in its stowed position. One of the latches, latch 64, is pivoted on a frame element 66, which has a rearwardly open notch for receiving a journal 68 fixed to, and projecting laterally from, channel 56 of the discharge conveyor. Latch 64 can be held alternatively in its closed position, or in its released position as shown, by a pin which can be slid manually into and out of a hole in frame element 66. As shown in FIGS. 1 and 5, a forwardly facing notch 69, and a similar pivoted latch 70, are located rearward of latch 66, at a location which is preferably underneath, or approximately underneath, the comminutor 24. Latch 70 is manually pivotable, from its open position, to its closed position by an elongated, rearwardly extending control arm 72. Latches (not shown) similar to latches 64 and 70 may be provided on the opposite side of the trailer. Thus, the discharge conveyor 54 may be secured to frame 12 during transport by the latch 64 and its counterpart on the opposite side of the trailer. When secured for transport, a part of the discharge conveyor is positioned underneath the intake conveyor 22.

Figure 2:
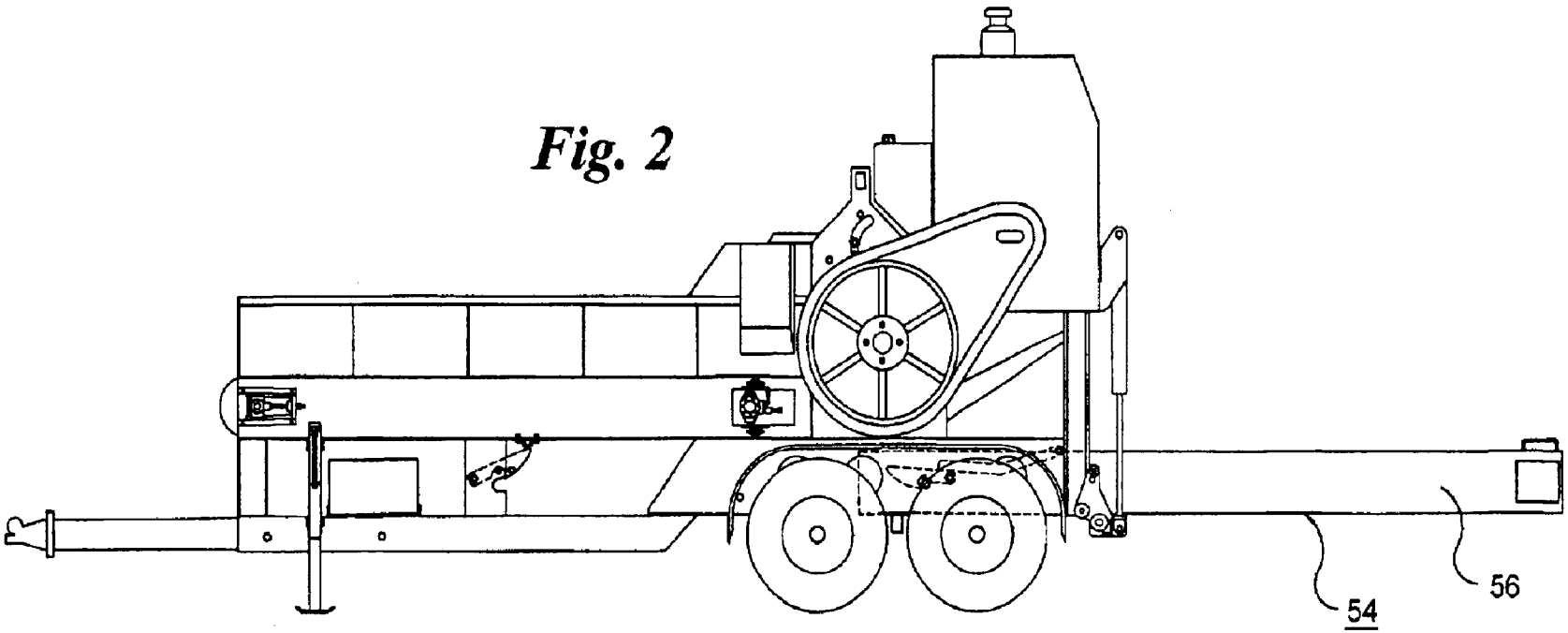
FIG. 2 is a side elevation of the shredder, with the discharge conveyor in its horizontally extended position.
Figure 3:
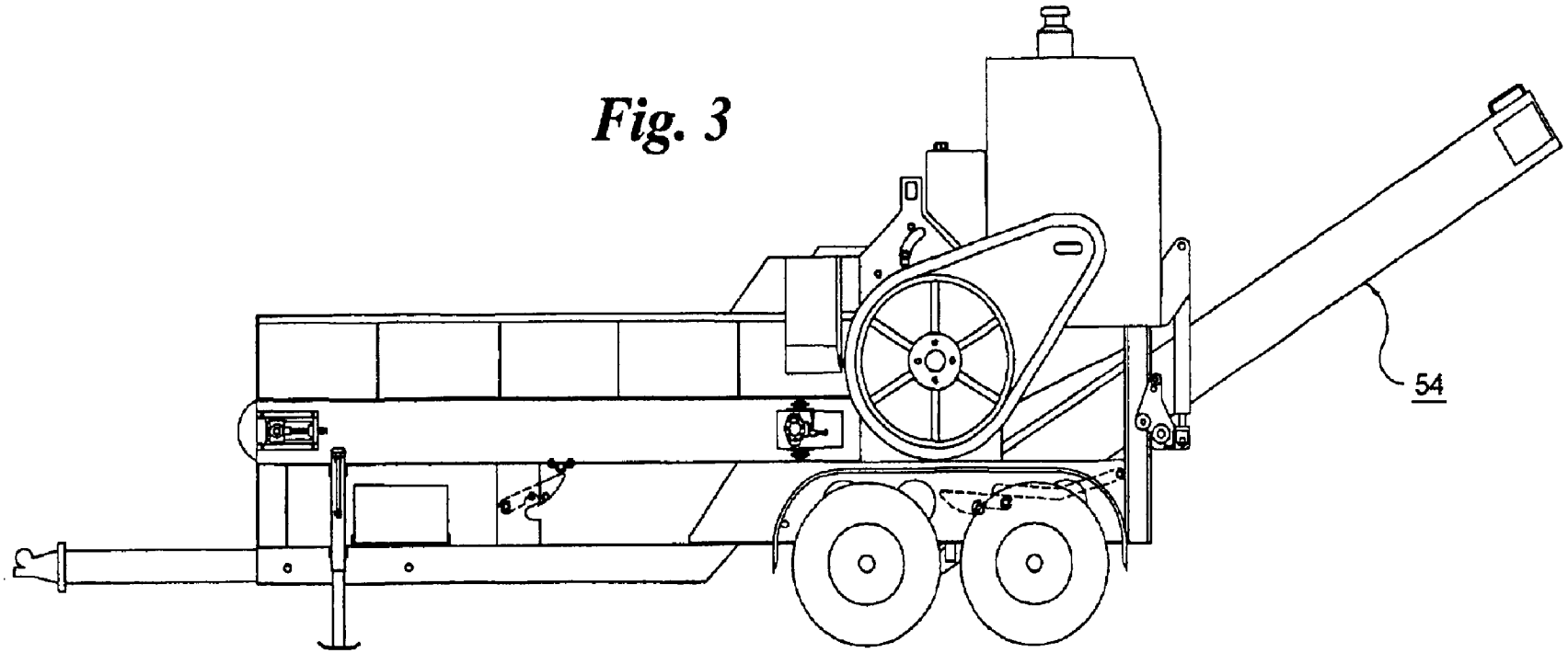
FIG. 3 is a side elevation of the shredder, with the discharge conveyor in its operating position.

As shown in FIG. 2, the discharge conveyor can slide horizontally rearward to a position in which it extends horizontally rearward from the trailer. As the discharge conveyor approaches this position, the conveyor frame, composed of channels 56 and 58 (FIG. 4), continues to rest on horizontal roller 48, and is maintained in its horizontal condition by engagement of the tops of the channels with a pair of rollers (not shown in FIG. 2) mounted on bearings on the frame 12, and rotatable on a common axis extending laterally across frame 12 at a location underneath, or approximately underneath, the comminutor. Thus the discharge conveyor is cantilevered as it approaches its horizontally extended position. When the discharge conveyor reaches its extended position, as shown in FIG. 2, it continues to be supported in cantilever fashion, and its laterally projecting journal 68 enters a notch in the frame 12. Control arm 72 can then be raised, closing the latch, so that the notch and latch, cooperating with each other, serve as a bearing about which the discharge conveyor can pivot upward toward the operating position depicted in FIG. 3. A similar bearing (not shown) is preferably provided by a notch and latch on the frame 12 at the opposite side of the discharge conveyor.

To raise the discharge conveyor toward its operating position, the linear actuators are operated so that their pistons 44 and 46 retract into their cylinders 40 and 42 respectively, causing roller 48 to lift the discharge conveyor, pivoting it about an axis extending laterally of the frame 12 at the location of the bearings formed by the rearwardly located notches and latches. The discharge conveyor is supported by the actuators during operation, but is preferably secured in place by one or more chains or cables as a precaution against failure of the actuators or the hydraulic system which operates them.

As will be apparent from the above description, the shredder in accordance with the invention can be used to reduce any of a wide variety of materials, including pallets, framing lumber, drywall, brush, cardboard, etc. The discharge conveyor can be easily moved from its stowed position to its operating position, and from its operating position to its stowed position. When the discharge conveyor is stowed, the trailer is properly balanced for attachment to a towing vehicle, and in a position such that it is not susceptible to damage as a result of inertia due to bumps and other highway irregularities.

The shredder in accordance with the invention is smaller in size, and lighter in weight than prior shredders having comparable throughput capabilities. A typical shredder according to the invention can be powered by a 170 horsepower gasoline engine, which will operate not only the toothed cutting drum, but also one or more hydraulic pumps used to operate the intake and discharge conveyors, and the hydraulic actuators used to lift the discharge conveyor to its operating position. The length of the intake conveyor is typically about 10 feet, and its width is typically about 56 inches. the length of the discharge conveyor is typically about 12 feet and its width is typically about 41 inches. The overall length of the trailer is typically 19 feet, 5 inches, including the tow hitch, and its width is 7 feet, 6 inches. The tow hitch can be released from its extended condition by removing bolts, and slid underneath the frame so that it can be moved out of the way of operating personnel for more convenient loading of the intake conveyor. When the tow hitch is underneath the frame, the overall length of the trailer is typically 15 feet, 5 inches. The weight of the trailer and machinery thereon is typically about 12025 pounds. The dimensions and overall weight can, of course, be modified, depending on various requirements such as weight and size limitations, and the size of the materials to be shredded.

Various other modifications can be made to the shredder as described. For example, the hydraulic motor which operates the discharge conveyor, can be connected to a hydraulic pumps and control valves through flexible hydraulic lines provided with quick-disconnect couplings, which can be connected when the discharge conveyor is in its operating position. In this way, the lengths of the hydraulic lines can be reduced. The pair of cantilever rollers which engage the top of the discharge conveyor frame as it is moved to its extended condition can be replaced by a single roller which extends across the width of the discharge conveyor. Conversely, the lift roller and the other support rollers underneath the discharge conveyor can be replaced by individual rollers which separately engage the channels forming the sides of the discharge conveyor frame. Although the discharge conveyor is preferably pivoted by releasable engagement of a pair of laterally extending journals with bearings mounted on the machine frame, in an alternative embodiment, a single journal, in the form of a circular, cylindrical rod, could extend laterally across the discharge conveyor adjacent the proximal end thereof, and one or more bearings could be provided on the machine frame underneath the discharge conveyor for releasably receiving the single journal.

Still other modifications may be made to the apparatus and method described above without departing from the scope of the invention as defined in the following claims.

What is claimed is:

1. A shredder comprising:

a machine frame having wheels whereby the machine frame can be transported;

a comminutor mounted on said machine frame, said comminutor having an intake side and a discharge side opposite from the intake side;

an intake conveyor mounted on the machine frame on the intake side of the comminutor and arranged to carry articles to be shredded toward the comminutor; and a discharge conveyor, having first and second opposite ends, for transporting shredded material along a path extending along a direction extending from said first end toward said second end;

said discharge conveyor being movable from an operating position in which said direction extends obliquely upward, and in which at least part of the discharge conveyor is located on the discharge side of the comminutor, to a stowed position in which said direction extends substantially horizontally, and in which at least part of said discharge conveyor between said first end second ends thereof, is located directly underneath said intake conveyor.

2. A shredder comprising:

a machine frame having wheels whereby the machine frame can be transported;

a comminutor mounted on said machine frame, said comminutor having an intake side and a discharge side opposite from the intake side;

an intake conveyor mounted on the machine frame on the intake side of the comminutor and arranged to carry articles to be shredded toward the comminutor; and a discharge conveyor;

said discharge conveyor being movable from a stowed position, in which a part of the discharge conveyor is disposed underneath the intake conveyor, to an operating position in which the discharge conveyor extends obliquely upward, and in which at least part of the discharge conveyor is located on the discharge side of the comminutor; and said shredder having a guide for guiding movement of the discharge conveyor in a horizontal path from said stowed position to an extended position in which the discharge conveyor extends horizontally away from the comminutor on the discharge side of the comminutor, and having a lifting mechanism for lifting the discharge conveyor from said extended position to said operating position.

3. A shredder according to claim 2, having a motor arranged to drive the comminutor, and a motor support extending upward from said machine frame, for supporting said motor above the machine frame at a location adjacent the comminutor, in which said lifting mechanism comprises a member engageable with the discharge conveyor, and at least one linear actuator having first and second relatively movable parts, the first part being affixed to said motor support at a location above said machine frame, and the second part being connected to said member engageable with the discharge conveyor.

4. A shredder according to claim 3, in which said discharge conveyor comprises a discharge conveyor frame and an endless movable conveyor belt supported on said discharge conveyor frame, in which said member engageable with the discharge conveyor is a roller positionable underneath the discharge conveyor frame when the discharge conveyor is in said extended position, and engageable with the discharge conveyor frame to lift the discharge conveyor frame in response to operation of said at least one linear actuator.

5. A shredder according to claim 3, in which said motor support includes a guide rail extending upward from said machine frame, and having a guide connected to said second part of the linear actuator and constrained to travel along said guide rail.

6. A shredder according to claim 3, in which said comminutor has a discharge opening, in which said discharge conveyor comprises a discharge conveyor frame having proximal and distal ends, an endless movable conveyor belt supported on said discharge conveyor frame, and a pair of journals extending laterally from said discharge conveyor frame adjacent the proximal end thereof, said journals being aligned with each other on a pivot axis, a pair of bearings mounted on said machine frame adjacent the comminutor discharge opening, said bearings being positioned respectively to support said journals rotatably when the discharge conveyor is in its extended position, at least one of said bearings comprising a first part having a notch for receiving one of said journals as the conveyor is moved into its said extended position, and a latch for releasably holding said one of said journals in the notch.

7. A shredder according to claim 6, in which said latch is a pivoted latch, and including an elongated control arm for manually opening and closing said latch, whereby the latch can be operated from a location remote from the discharge opening of the comminutor.

8. A shredder according to claim 3, in which said comminutor has a discharge opening, in which said discharge conveyor comprises a discharge conveyor frame having proximal and distal ends, an endless movable conveyor belt supported on said discharge conveyor frame, and a pair of journals extending laterally from said discharge conveyor frame adjacent the proximal end thereof, said journals being aligned with each other on a pivot axis, a pair of bearings mounted on said machine frame adjacent the comminutor discharge opening, said bearings being positioned respectively to support said journals rotatably when the discharge conveyor is in its extended position, and each of said bearings comprising a first part having a notch for receiving one of said journals as the conveyor is moved into its said extended position, and a latch for releasably holding said one of said journals in the notch.

9. A shredder according to claim 8, in which each said latch is a pivoted latch, and including an elongated control arm for manually opening and closing each said latch, whereby the latches can be operated from locations remote from the discharge opening of the comminutor.

10. A shredder according to claim 2, in which said guide is arranged to guide movement of the discharge conveyor in said horizontal path, in a fore and aft direction, from said stowed position to said extended position, in which said discharge conveyor comprises a discharge conveyor frame having a top side and an underside, and an endless, movable, conveyor belt supported on said discharge conveyor frame, and in which said guide includes at least two rollers positioned to be in contact with the underside of the discharge conveyor frame respectively fore and aft of the center of gravity of the discharge conveyor when the discharge conveyor is in its stowed position, and at least one additional roller, located forward of one of said at least two rollers, and aft of the other of said at least two rollers, and positioned to be in contact with the top side of the conveyor frame when the discharge conveyor is in said extended position, whereby the discharge conveyor is cantilevered by said additional roller and said other of said at least two rollers when the discharge conveyor is in said extended position.

11. A shredder according to claim 2, in which said comminutor has a discharge opening, in which said discharge conveyor comprises an elongated discharge conveyor frame having proximal and distal ends, a journal connected to said discharge conveyor frame adjacent the proximal end thereof, said journal extending in the lateral direction relative to the direction of elongation of the discharge conveyor frame, a bearing mounted on said machine frame adjacent the comminutor discharge opening, said bearing releasably receiving said journal and supporting said journal rotatably when the discharge conveyor is in its extended position, whereby said discharge conveyor can be pivoted, on said bearing, from said extended position to said operating position.

12. A shredder according to claim 11, in which said bearing includes a latch of releasably holding said journal in engagement with said bearing.

13. A shredder according to claim 12, in which said latch is a pivoted latch, and including an elongated control arm for manually opening and closing said latch, whereby the latch can be operated from a location remote from the discharge opening of the comminutor.

14. A shredder according to claim 2, in which said comminutor has a discharge opening, in which said discharge conveyor comprises a discharge conveyor frame having proximal and distal ends, and a pair of journals extending laterally from said discharge conveyor frame adjacent the proximal end thereof, said journals being aligned with each other on a pivot axis, a pair of bearings mounted on said machine frame adjacent the comminutor discharge opening, said bearings being positioned respectively to support said journals rotatably when the discharge conveyor is in its extended position, at least one of said bearings having a latch for releasably holding one of said journals in rotating relationship with said one of said bearings, whereby said discharge conveyor can be pivoted about said pivot axis from said extended position to said operating position.

15. A shredder according to claim 14, in which said latch is a pivoted latch, and including an elongated control arm for manually opening and closing said latch, whereby the latch can be operated from a location remote from the discharge opening of the comminutor.

16. A shredder according to claim 2, in which said comminutor has a discharge opening, in which said discharge conveyor comprises a discharge conveyor frame having proximal and distal ends, an endless movable conveyor belt supported on said discharge conveyor frame, and a pair of journals extending laterally from said discharge conveyor frame adjacent the proximal end thereof, said journals being aligned with each other on a pivot axis, a pair of bearings mounted on said machine frame adjacent the comminutor discharge opening, said bearings being positioned respectively to support said journals rotatably when the discharge conveyor is in its extended position, at least one of said bearings comprising a first part having a notch for receiving one of said journals as the conveyor is moved into its said extended position, and a latch for releasably holding said one of said journals in the notch.

17. A shredder according to claim 16, in which said latch is a pivoted latch, and including an elongated control arm for manually opening and closing said latch, whereby the latch can be operated from a location remote from the discharge opening of the comminutor.

* * * * *